US007396012B2

(12) United States Patent
Bobrow

(10) Patent No.: US 7,396,012 B2
(45) Date of Patent: Jul. 8, 2008

(54) FLEXIBLE PAPER PATH USING MULTIDIRECTIONAL PATH MODULES

(75) Inventor: Daniel G. Bobrow, Palo Alto, CA (US)

(73) Assignee: Xerox Corporation, Norwalk, CT (US)

( * ) Notice: Subject to any disclaimer, the term of this patent is extended or adjusted under 35 U.S.C. 154(b) by 545 days.

(21) Appl. No.: 10/881,619

(22) Filed: Jun. 30, 2004

(65) Prior Publication Data

US 2006/0012102 A1 Jan. 19, 2006

(51) Int. Cl.
*B65H 29/64* (2006.01)

(52) U.S. Cl. ..... 271/185; 271/184; 271/279; 271/299; 271/300; 271/225; 271/264; 271/302; 399/391; 270/52.14

(58) Field of Classification Search ..... 271/184, 271/185, 279, 299, 300, 225, 264, 302; 399/18–21, 399/391; 270/52.14, 52.16
See application file for complete search history.

(56) References Cited

U.S. PATENT DOCUMENTS

| | | | | |
|---|---|---|---|---|
| 4,579,446 | A | 4/1986 | Fujino et al. | |
| 4,587,532 | A | 5/1986 | Asano | |
| 4,836,119 | A | 6/1989 | Siraco et al. | |
| 5,004,222 | A | 4/1991 | Dobashi | |
| 5,080,340 | A | 1/1992 | Hacknauer et al. | |
| 5,095,342 | A | 3/1992 | Farrell et al. | |
| 5,159,395 | A | 10/1992 | Farrell et al. | |
| 5,178,381 | A * | 1/1993 | Nash et al. | 271/264 |
| 5,208,640 | A | 5/1993 | Horie et al. | |
| 5,272,511 | A | 12/1993 | Conrad et al. | |
| 5,326,093 | A | 7/1994 | Sollitt | |
| 5,435,544 | A | 7/1995 | Mandel | |
| 5,462,399 | A * | 10/1995 | Clupper et al. | 414/790.3 |
| 5,473,419 | A | 12/1995 | Russel et al. | |
| 5,489,969 | A | 2/1996 | Soler et al. | |
| 5,504,568 | A | 4/1996 | Saraswat et al. | |
| 5,525,031 | A | 6/1996 | Fox | |
| 5,557,367 | A | 9/1996 | Yang et al. | |
| 5,568,246 | A | 10/1996 | Keller et al. | |
| 5,570,172 | A | 10/1996 | Acquaviva | |

(Continued)

FOREIGN PATENT DOCUMENTS

EP 1 246 449 A2 10/2002

(Continued)

OTHER PUBLICATIONS

U.S. Appl. No. 10/761,522, filed Jan. 21, 2004, Mandel et al.

(Continued)

*Primary Examiner*—Patrick Mackey
*Assistant Examiner*—Gerald W McClain
(74) *Attorney, Agent, or Firm*—Eugene O. Palazzo; Fay Sharpe LLP

(57) ABSTRACT

A modular flexible media handling apparatus includes an input module (28) through which flexible media enters the apparatus, at least one main path module (28, 30, 32, 34) through which flexible media passes along a main path (24), at least one lookaside module (36, 38) through which flexible media selectively passes along a lookaside path, and an output module (34) in which flexible media from the lookaside path and main path are merged.

28 Claims, 7 Drawing Sheets

U.S. PATENT DOCUMENTS 5,596,416 A 1/1997 Barry et al.
5,629,762 A 5/1997 Mahoney et al.
5,634,636 A 6/1997 Jackson et al.
5,710,968 A 1/1998 Clark et al.
5,778,377 A 7/1998 Marlin et al.
5,810,346 A * 9/1998 Jorg ..... 270/59
5,868,387 A * 2/1999 Kida et al. ..... 271/304
5,884,910 A 3/1999 Mandel
5,995,721 A 11/1999 Rourke et al.
5,999,758 A 12/1999 Rai et al.
6,057,930 A 5/2000 Blossey et al.
6,059,284 A 5/2000 Wolf et al.
6,125,248 A 9/2000 Moser
6,161,828 A * 12/2000 Sussmeier ..... 270/59
6,164,640 A * 12/2000 Stengl et al. ..... 271/187
6,186,339 B1 * 2/2001 Saltsov et al. ..... 209/534
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 * 4/2003 Jackson et al. ..... 271/301
6,559,961 B1 5/2003 Isernia et al.
6,577,925 B1 6/2003 Fromherz
6,607,320 B2 * 8/2003 Bobrow et al. ..... 400/188
6,608,988 B2 8/2003 Conrow
6,612,566 B2 9/2003 Stoll
6,612,571 B2 * 9/2003 Rider ..... 271/279
6,621,576 B2 9/2003 Tandon et al.
6,626,110 B1 * 9/2003 Keller ..... 101/485
6,633,382 B2 10/2003 Hubble, III et al.
6,639,669 B2 10/2003 Hubble, III et al.
6,819,906 B1 11/2004 Herrmann et al.
7,093,831 B2 * 8/2006 Biegelsen et al. ..... 271/184
7,100,911 B2 * 9/2006 Middelberg et al. ..... 271/9.01
2002/0078012 A1 6/2002 Ryan et al.
2002/0103559 A1 8/2002 Gartstein
2002/0140165 A1 * 10/2002 Jackson et al. ..... 271/291
2003/0077095 A1 4/2003 Conrow
2003/0107169 A1 * 6/2003 Rider ..... 271/225
2004/0085561 A1 5/2004 Fromherz
2004/0085562 A1 5/2004 Fromherz
2004/0088207 A1 5/2004 Fromherz
2004/0150156 A1 * 8/2004 Fromherz et al. ..... 271/272
2004/0150158 A1 * 8/2004 Biegelsen et al. ..... 271/303
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 * 12/2004 Lofthus et al. ..... 400/582
2004/0253033 A1 * 12/2004 Lofthus et al. ..... 400/582
2005/0158098 A1 * 7/2005 Mandel et al. ..... 399/407
2005/0167903 A1 * 8/2005 Hartl et al. ..... 271/2
2005/0179198 A1 * 8/2005 Biegelsen et al. ..... 271/303
2005/0189693 A1 * 9/2005 Ko ..... 271/9.02
2005/0212199 A1 * 9/2005 Duff et al. ..... 271/264
2007/0029721 A1 * 2/2007 Duff et al. ..... 271/185

FOREIGN PATENT DOCUMENTS

EP 1 391 849 A1 2/2004

OTHER PUBLICATIONS

U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 24, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2000, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/120,589, filed May 3, 2005, Contino.
U.S. Appl. No. 11/102,332, filed Apr. 8, 2005, Hindi et al.
"Xerox Disclosure Journal", publication of Nov.-Dec. 1991, vol. 16, No. 6, pp. 381-383 by Paul F. Morgan.
"TAX" publication "Cluster Printing Solution Announced" (Aug. 3, 2001).

* cited by examiner

FLEXIBLE PAPER PATH USING MULTIDIRECTIONAL PATH MODULES

BACKGROUND

The present exemplary embodiment relates to a flexible media transport system. In particular, it relates to a printing or copying system with a lookaside path which enables movement of paper sheets into or out of a main paper path and will be described with particular reference thereto. However, it is to be appreciated that the present exemplary embodiment is also amenable to other like applications.

In a typical copying/printing apparatus, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with developing powder referred to in the art as toner. This image may subsequently be transferred to a support surface, such as copy paper, to which it may be permanently affixed by heating and/or by the application of pressure, i.e., fusing.

In a conventional printing apparatus, sheet material or paper is handled by a series of rollers and counter rollers. The counter roller generates forces normal to the tangential surface of a roller for handling the sheet. Counter rollers, however, sometimes lead to jams, paper tears, wrinkling, or other surface damage to the sheet. The normal operation of the printer may be interrupted for some time while the damaged sheets are removed.

Traditional rollers form what is know in the field as a non-holonomic sheet transport system because only a limited number of directions of movement are possible for the sheet at a given time. Where sheets are to be merged, an interposer or sheet inserter is used. Examples of such sheet inserters are disclosed, for example, in U.S. Pat. No. 6,559,961 to Isernia, et al. and U.S. Pat. No. 5,995,721 to Rourke, et al. Isernia, et al. discloses a system for printing jam-prone sheets. These are printed as separated pages prior to printing any of the other electronic pages. The system temporarily holds them in an interposer, then prints the other pages of the document onto normal sheets, and provides collated merging in the interposer to provide collated output of the entire electronic document. Rourke, et al. discloses a queuing system for examining document attributes and delivering one or more portions of the document to one or more document processing subsystems and then merging the document portions.

Reconfigurable printing systems increasingly consist of multiple parallel, alternative modules that are connected through flexible paths or loops. Such systems offer a multitude of alternative operations (or capabilities) to produce the same or different outputs. For example, a modular printing system may consist of several identical, parallel printers connected through flexible paper paths that feed to and collect from these printers.

U.S. Pat. No. 6,607,320 to Bobrow, et al., and U.S. Pat. No. 6,554,276 to Jackson, et al., which are incorporated herein in their entireties by reference, disclose an apparatus for processing a substrate on two sides. The apparatus of Bobrow includes an input pathway for receiving the substrate from a substrate processing station, a station for processing the face-up side of the substrate, a reversion pathway for reverting the substrate and returning the reverted substrate to the input pathway. A merge point merges the reverted substrate into the input pathway for processing the face-up side of the substrate in the print station. The substrate is manipulated in the reversion pathway by a plurality of air jets. In such systems, all the sheets start and finish on the input pathway and those that have passed along the reversion pathway are changed in their orientation.

BRIEF DESCRIPTION

In accordance with one aspect of the present exemplary embodiment, a modular flexible media handling apparatus is provided. The apparatus includes an input module through which flexible media enters the apparatus, at least one main path module through which flexible media passes along a main path, and at least one lookaside module through which flexible media selectively passes along a lookaside path. The lookaside path communicates with the main path whereby flexible media is transferred between the main path and the lookaside path.

In accordance with another aspect of the present exemplary embodiment, a method of transporting flexible media is provided. The method includes transporting flexible media from an input module along at least one main path module through which the flexible media passes along a main path and selectively transporting flexible media between the main path and a lookaside module, through which the flexible media can selectively pass along a lookaside path. The method further includes selectively merging flexible media from the lookaside path and main path and outputting the merged flexible media.

The term "marking device" or "printer" as used herein broadly encompasses various printers, copiers or multifunction machines or systems, xerographic or otherwise, unless otherwise defined in a claim.

The term "sheet" herein refers to a usually flimsy physical sheet of paper, plastic, or other suitable physical print media substrate for images, whether precut or web fed. "Flexible media," as used herein, broadly encompasses print media substrates for images as well as other generally planar objects which are not necessarily undergoing an imaging process.

A "print job" is normally a set of related sheets, usually one or more collated copy sets copied from a set of original document sheets or electronic document page images, from a particular user, or which are otherwise related.

A "finisher," as broadly used herein, is any post-printing accessory device such as an inverter, reverter, sorter, mailbox, inserter, interposer, folder, stapler, stacker, collater, stitcher, binder, over-printer, envelope stuffer, postage machine, or the like.

DETAILED DESCRIPTION

Figure 1:
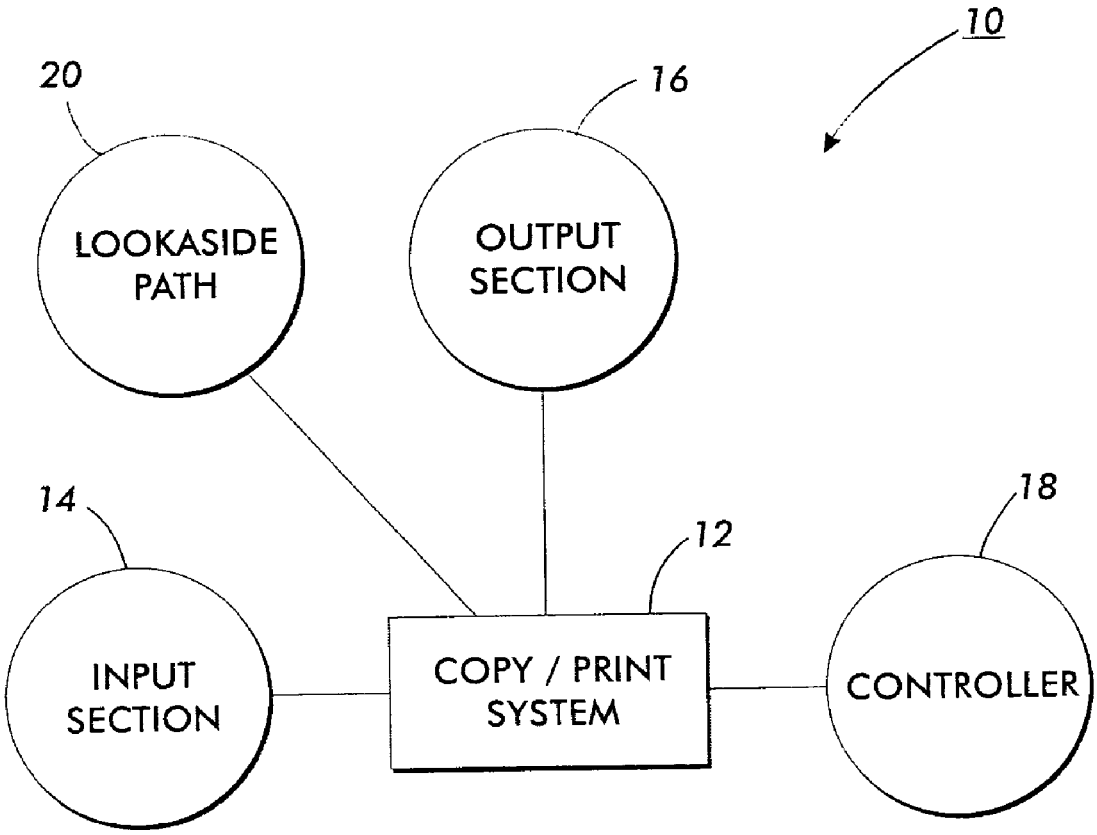
FIG. 1 is a block diagram of one embodiment of a system for processing a flexible substrate.

Disclosed in an embodiment herein is a modular flexible media handling apparatus. The apparatus includes an input module through which flexible media enters the apparatus and at least one main path module through which flexible media passes along a main path. The media handling apparatus includes at least one lookaside module through which flexible media selectively passes along a lookaside path. The lookaside path communicates with the main path whereby flexible media is transferred between the main path and the lookaside path.

The apparatus thus described may further include an output module in which flexible media from the lookaside path and main path are merged. The main path module may be configured for moving media along at least first and second angularly spaced axes. The first axis may be collinear with the main path. The first and second angularly spaced axes may be generally perpendicular. In one embodiment, the main path module accepts media from the input module. The main path module may accept media from the input module along the first axis and send media to the first lookaside module along the second axis. In one embodiment, the main path module sends media to a first lookaside module. The apparatus may further include a second main path module, the first main path module accepting media from the input module and selectively sending the media to the first lookaside module or to the second main path module. The media may be sent to the first lookaside module along a different axis than media sent to the second main path module. In one embodiment, the lookaside module can selectively move media along at least first and second axes. A media processing unit may be connected to one of the lookaside modules for receiving media from the lookaside module and/or delivering media to the lookaside module. The media processing unit may include one or more of a marking device, a finisher, a jam output tray, and a quality consistency checker. In one embodiment, a plurality of the main path modules and lookaside path modules is capable of selectively moving media along two axes, the axes of each module being coplanar with the axes of an adjacent module. All of the main path modules and lookaside path modules may be each capable of selectively moving media along two axes, the axes of each module being coplanar with the axes of the other modules. In one embodiment, there are at least two main path modules and at least two lookaside modules. The lookaside modules and the main path modules may each include a sheet transporting system which provides selectable sheet translation and/or rotation. The sheet transport system may include a plurality of independently operable, spaced sheet driving elements which cooperate for moving flexible media along at least the first and second angularly spaced axes. The lookaside modules and the main path modules may each include at least one sheet position sensor for sensing a position of a sheet. A plurality of the lookaside modules and the main path modules may be interchangeable and repositionable. In one embodiment, the main path extends between a first input module and a first output module. The apparatus may further comprise at least one of a second input module and a second output module connected with the lookaside path.

Disclosed in another embodiment herein is a method of transporting flexible media which includes transporting flexible media from an input module along at least one main path module through which the flexible media passes along a main path, selectively transporting flexible media between the main path and a lookaside module, through which the flexible media can selectively pass along a lookaside path, selectively merging flexible media from the lookaside path and main path, and outputting the merged flexible media. The method may further include storing flexible media in the lookaside path for a period of time whereby an order of the merged flexible media is different from an order of the flexible media leaving the input module.

With reference to FIG. 1, by way of example, a block diagram of a system 10 for processing a flexible substrate, such as paper, is illustrated. The system 10 can generally comprise a marking device, such as a printing or copying apparatus 12. The apparatus 12 can include an input section 14, an output section 16, and a controller 18. The input section 14 can comprise, for example, an image input terminal ("IIT") and the output section 16 can comprise, for example, an image output terminal ("IOT"), finisher, or the like. The apparatus 12 also includes a lookaside path 20. The system 10 enables diversion, insertion, and/or rescheduling functions to be performed in a simple and efficient manner.

Figure 2:
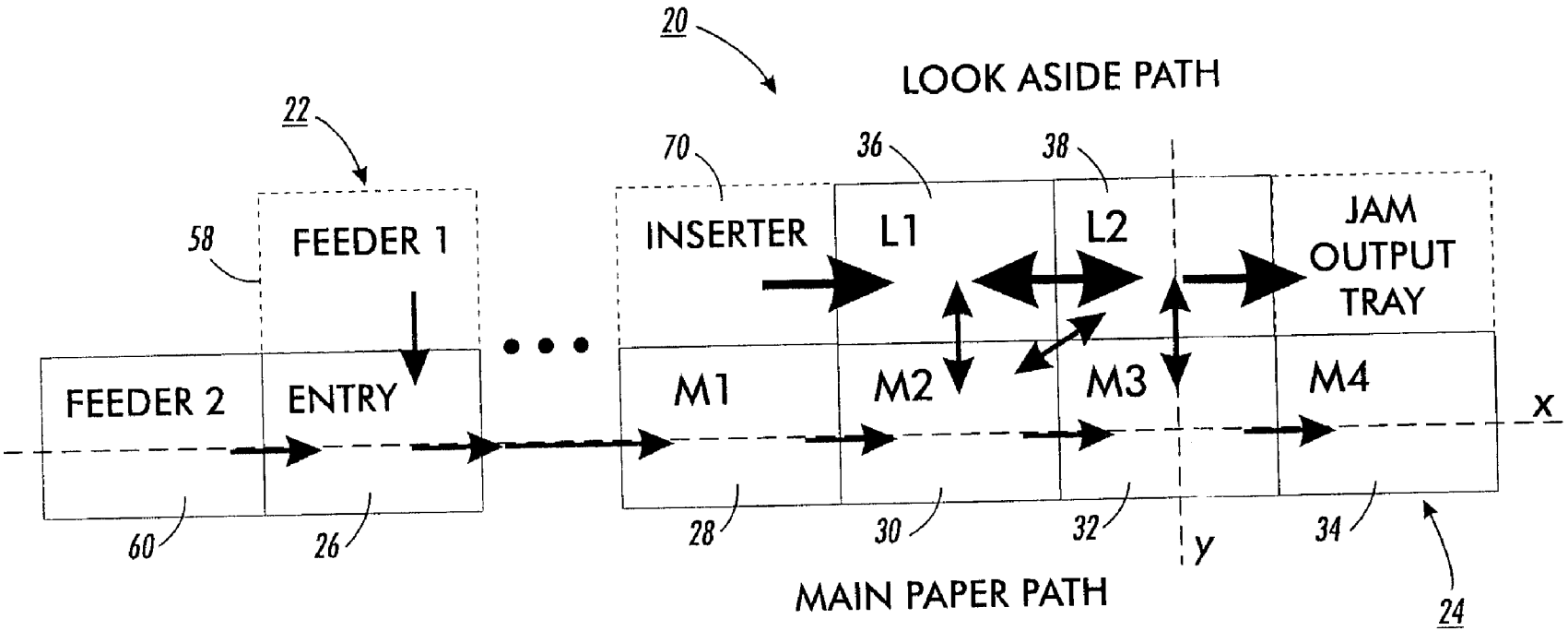
FIG. 2 is a block diagram of a top view of a first embodiment of a paper path for the system of FIG. 1, illustrating the pathways for movement of sheets.

Referring to FIG. 2, the lookaside path 20 is generally a part of a paper path 22 or object path within the system. The paper path 22 includes a main paper path 24 which connects a paper entry point and a paper output destination. The lookaside path 20 is connected with the main path 24 for accepting sheets of paper from the main path and delivering sheets to the main path.

While reference is made herein to the transport of sheets of paper, it will be appreciated that the transport of other generally planar substrates and/or other flexible media is also contemplated. Generally, flexible media can include any flexible objects that can be adapted to be transported by the transport system, such as for example, sheets of paper, items of mail, banknotes, or the like. Moreover, although the use of the lookaside path 20 is described herein in conjunction with a print/copy apparatus 12, it should be recognized and understood that the lookaside path can be incorporated into any system that requires that a substrate be moved into or out of a main path 24.

The arrows in FIG. 2 indicate at least some of the directions in which the paper can travel on the paper path 22. For example, paper sheets are transported along the main path 24 in a direction parallel with a first axis X. Paper sheets are transported between the main path and the lookaside path in a direction parallel with a second axis Y. In the illustrated embodiment, X and Y axes are perpendicular to one another, although it is to be understood that the X and Y axes may be situated at any convenient angle to one another, e.g., at an angle of from 45-135°. Paper sheets can be transported along the lookaside path 24 in a direction generally parallel with the first axis X, although it is also contemplated that the lookaside path may include portions in which the paper is transported in a different direction.

Applied transporting forces are directed against the paper to longitudinally transport the sheet in a specific direction. As will be appreciated, the longitudinal force gradient also results in longitudinal tensioning forces on paper or other flexible objects. In addition, lateral tensioning forces substantially perpendicular to the transporting forces can be maintained on edges of the sheets. These combined longitudinal and lateral tensioning forces result in flattening of the paper sheets.

The main path 24 of the paper path 22 may comprise an entry module 26 and a number of interchangeable and repositionable transport modules 28, 30, 32, 34 (four in the illustrated embodiment). It will be appreciated that the main path 24 may comprise fewer or more modules than shown. Module 34 serves as an output module in which the main path and lookaside paths are merged. In the illustrated embodiment, the lookaside path 20 runs parallel with a portion 30, 32 of the main path 24, providing a double width path (or greater, if desired) in the overlap region. The lookaside path 20 may comprise a number of interchangeable and repositionable transport modules 36, 38 (two in the illustrated embodiment), similar in construction to those used to form the main path. Each of the transport modules 28, 30, 32, 34, 36, 38 can be of sufficient size to accommodate at least one sheet of paper.

One or more of the modules 36, 38 of the lookaside path 20 can interact with the modules of the main path 24 as well as with outside elements, such as media processing units. In one embodiment, at least one module in the lookaside path accepts paper from the main path and at least one module in the lookaside path transfers paper to the main path. In the illustrated embodiment, modules 36 and 38 are capable of performing both of these functions. In one embodiment, the adjacent portions of the main path 24 and lookaside path 20 lie in the same plane such that sheets are movable between transport modules in the same plane. In another embodiment, transport modules of the main path 24 which interact with modules of the lookaside path 20 are in the same plane. In the specific embodiment illustrated in FIG. 2, all of the transport modules 28, 30, 32, 34, 36, 38 lie in the same plane.

In the illustrated embodiment, the transport modules 28, 30, 32, 34, 36, 38 are interchangeable and repositionable modular units, and thus can be identically or substantially identically formed (minor modifications may be made to modules linked to an external element). The interlocking modular units allow for quick and convenient layout of the transport system in a desired materials processing path. The modular nature of the lookaside path 20 and main path 24 allows the paths to be readily extended or otherwise reconfigured at will to meet the demands of the system. Indeed, each of the modules 28, 30, 32, 34, 36, 38 can be made up of smaller repositionable and interchangeable submodules (not shown), thereby allowing the width of the main path 24 or lookaside path 20 to be varied, for example, to accommodate larger sheets. Alternatively, the main and lookaside paths 24, 20 can be integrally formed, or otherwise of a fixed configuration.

It will be appreciated that a sheet or sheets of paper can be stored in or transported along the lookaside path 20 contemporaneously with transport of a sheet or sheets along an adjacent portion of the main path 24. For example, a first sheet may be moving from module 36 to module 38 while a second sheet is moving from module 30 to module 32.

Figure 3:
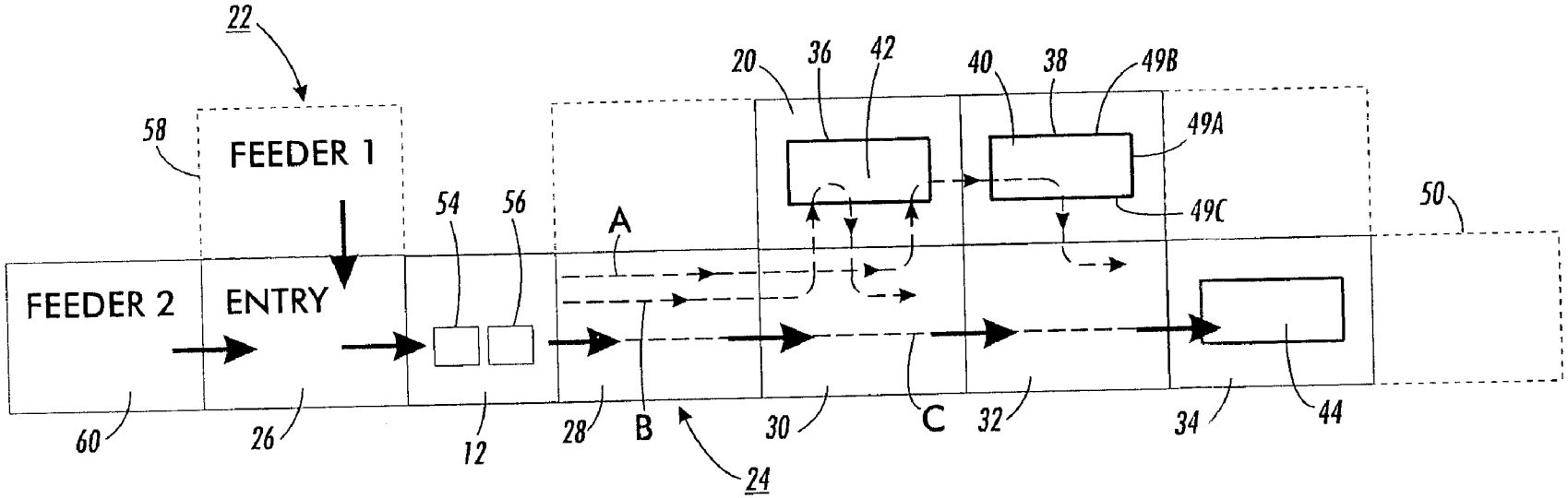
FIG. 3 is a block diagram of a top view of the paper path of FIG. 2, illustrating the reordering of sheets.

In one embodiment, the lookaside path 20 acts as a buffer for temporary storage of one or more sheets. This can be used to perform a reordering (reinsertion) function. The movement of the paper and the storage time in the lookaside path 20 are under the control of the controller 18. For example, as illustrated in FIG. 3, two sheets of paper 40, 42 are temporarily stored in the lookaside path 20 for later insertion into a stream moving along the main path 24. A first sheet of paper 40, following the route shown by arrows A, is first transported along the main path 24 from an input module 28 (upstream of the lookaside path) to module 30, which is adjacent the lookaside path 20 or otherwise accessible thereto. The input module 28 and module 30 form a part of the main path. An edge 49A of the sheet serves as the leading edge in this translation.

The sheet is then transferred to module 36 of the lookaside path 20 by changing the direction of movement of the sheet, in this case from a direction parallel with the X axis to a direction parallel with the Y axis. The change in direction of 90° results in a second edge 49B of the sheet acting as the leading edge. In this step, module 30 acts as an access module to the lookaside path.

The terms "upstream" and "downstream" are used with reference to the primary direction of travel of paper along the main path 24, from the module 26 to the output module 34, as indicated by the arrows along the X axis, although it is to be appreciated that travel on the main paper path 24 need not always be in the downstream direction.

From module 36, the paper sheet 40 is transported to module 38 in a direction parallel with the Y axis, with edge 49A once again serving as the leading edge (an alternative route could take the paper to module 32 and then to module 38). The paper is temporarily stored on module 38, to be inserted later. A second sheet of paper 42 follows a similar route, as shown by the arrows B, and is temporarily stored on module 36. A third sheet of paper 44, or a stream of multiple sheets, of which sheet 44 is the terminal sheet, continues on the main path 24, following the route shown by arrows C. The sheet 44 is transported to a module (e.g., module 34) which is at least one paper length downstream of the module from which a sheet is to be reinserted.

The controller 18 controls the length of time that the sheets 40, 42 are stored in the lookaside path 20 so that the sheets are reinserted at the appropriate place in the main stream. One or both of the reinsert sheets 40, 42 is then transported back to the main path 24. For example, sheet 40 is moved from module 38 to module 32 and sheet 42 to module 30, by moving both sheets in a direction perpendicular to the main paper path. In this translation, a third edge 49C of the sheet serves as the leading edge. These operations may be carried out concurrently, if both sheets are to be reinserted at the same point. Modules 30 and 32, in this step, act as reentry modules to the main path 24. Thus, it will be appreciated that a single module, module 30 in the illustrated embodiment, can serve as both an access module and a reentry module (during the reinsertion process). The path between the modules 30 and 36 can be described as bidirectional because the paper travels along it in a first direction when entering the lookaside path and in an opposite direction when leaving the lookaside path.

Alternatively, reinsertion is achieved by first transporting sheet 40 to module 32 and then moving it along the main path 24 to a module downstream, e.g., module 34. Sheet 42 can be transferred to module 38, once the module is empty, and thereafter transferred to module 32 of the main path 24. In this latter scenario, the paths between modules 30 and 36 and between modules 40 and 32 can both be described as unidirectional because transport occurs in a single direction only. Faster speeds may be achieved where any transfer path is used monodirectionally.

The reinserted sheet or sheets 40, 42 have the same orientation, upon rentry to the main path 24, as they had before leaving the main path, i.e., the same face of the sheet is uppermost and the same edge 49A of the sheet faces the downstream direction. However, it will be appreciated that the sheet may alternatively be rotated or even inverted prior to reentry, as will be described in greater detail below.

One use for such a reinsertion process is to allow sheets to be assembled out of sequence, for example, by a finisher 50 (FIG. 3), such as a stacker, collater, binder, stitcher, stapler, or the like. For example, a marking device 12 is located upstream of module 28. The apparatus 12 can comprise any conventional simplexing or duplexing printing/copying apparatus, such as for example an electrophotographic apparatus or a xerographic apparatus and include conventional components. An example of an electrophotographic apparatus can be seen in U.S. Pat. No. 6,057,930, which is incorporated herein by reference in its entirety.

In one embodiment, the marking device 12 comprises a plurality of marking modules 54, 56, such as print engines, each capable of marking sheets of paper. Modules 54, 56 may be arranged in series or in parallel. The finished document, or job, may have sheets of one type, e.g. black, to be printed by the first marking module 54, interspersed with sheets of another type, e.g., process color or single color, to be printed by the second marking module 56. In the illustrated embodiment, the marking device 12 is located downstream of the entry module 26. Sheets of paper are fed to the entry module from first and second feeders, 58, 60, such as paper cartridges or upstream marking devices. The lookaside path 20 allows sheets of one type, e.g., the color sheets, to be printed one after the other on the color marking module 56 and then some or all of these sheets 40, 42 to be stored on the lookaside path 20 while black sheets 44 are being printed. The sheets 40, 42 are reinserted into the main path 24 once the black sheets preceding the sheets 40, 42 in the document are transported to an appropriate location along the path.

Figure 4:
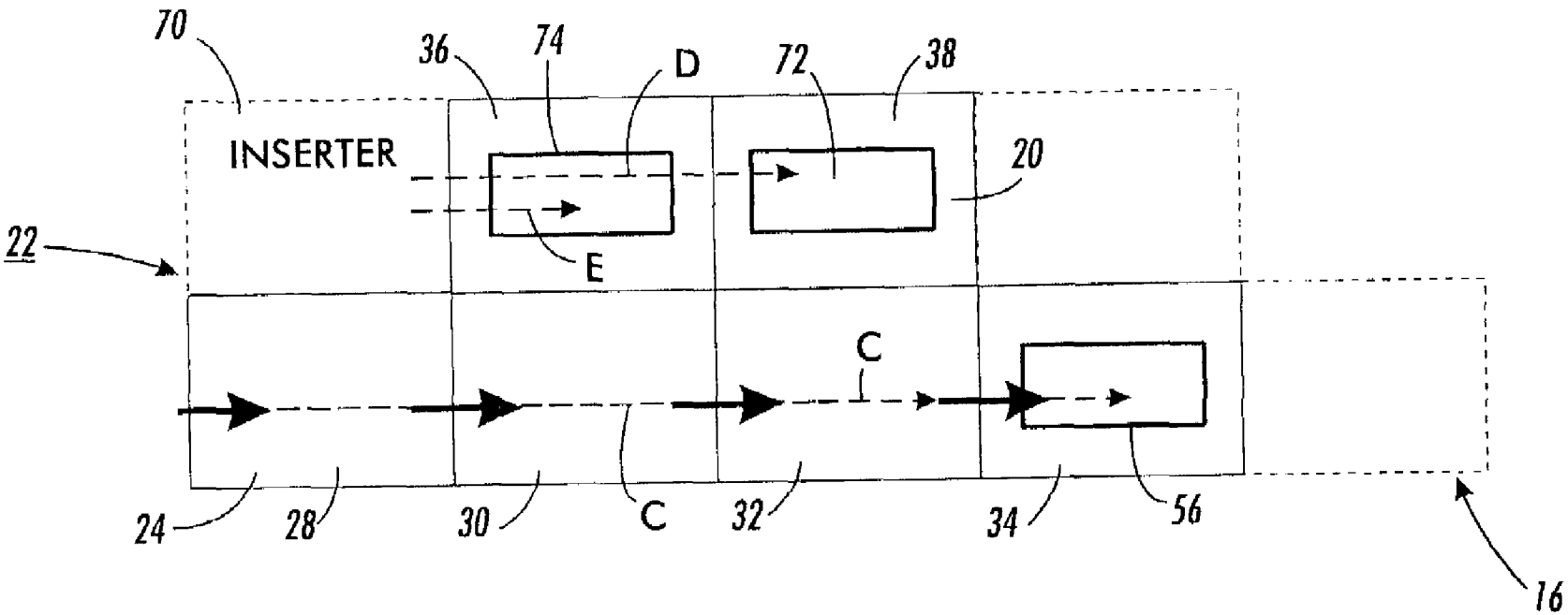
FIG. 4 is a block diagram of a top view of the paper path of FIG. 2, illustrating the insertion of sheets.

In another embodiment, illustrated in FIG. 4, sheets are inserted into the main path 24 from a second input module, such as an inserter 70. The inserter 70 may comprise a marking device which supplies already marked sheets of paper to the lookaside path 20, or may comprise a source of paper to be printed, such as a cassette or other paper feeding device. As with the embodiment of FIG. 3, a main paper stream, illustrated by sheet 56, follows the path of arrows C. Simultaneously with, or previous to the transport of sheet 56 along modules 30 and/or 32, one or more sheets 72 and 74 are sequentially introduced to the lookaside path along the routes marked by arrows D and E. At a point at which the sheets 72 and 74 are to be inserted into the main stream C, the controller 18 creates spaces in the main paper stream, for example, by temporarily increasing the pitch in a print engine (not shown) which supplies the main path 24. Pitch is the spacing between sheets, i.e., the length of the sheet and any gap between sheet and subsequent sheet. The spaces created on modules 30 and/or 32 allow the sheet or sheets 72, 74 to be inserted into the main stream after sheet 56.

Figure 5:
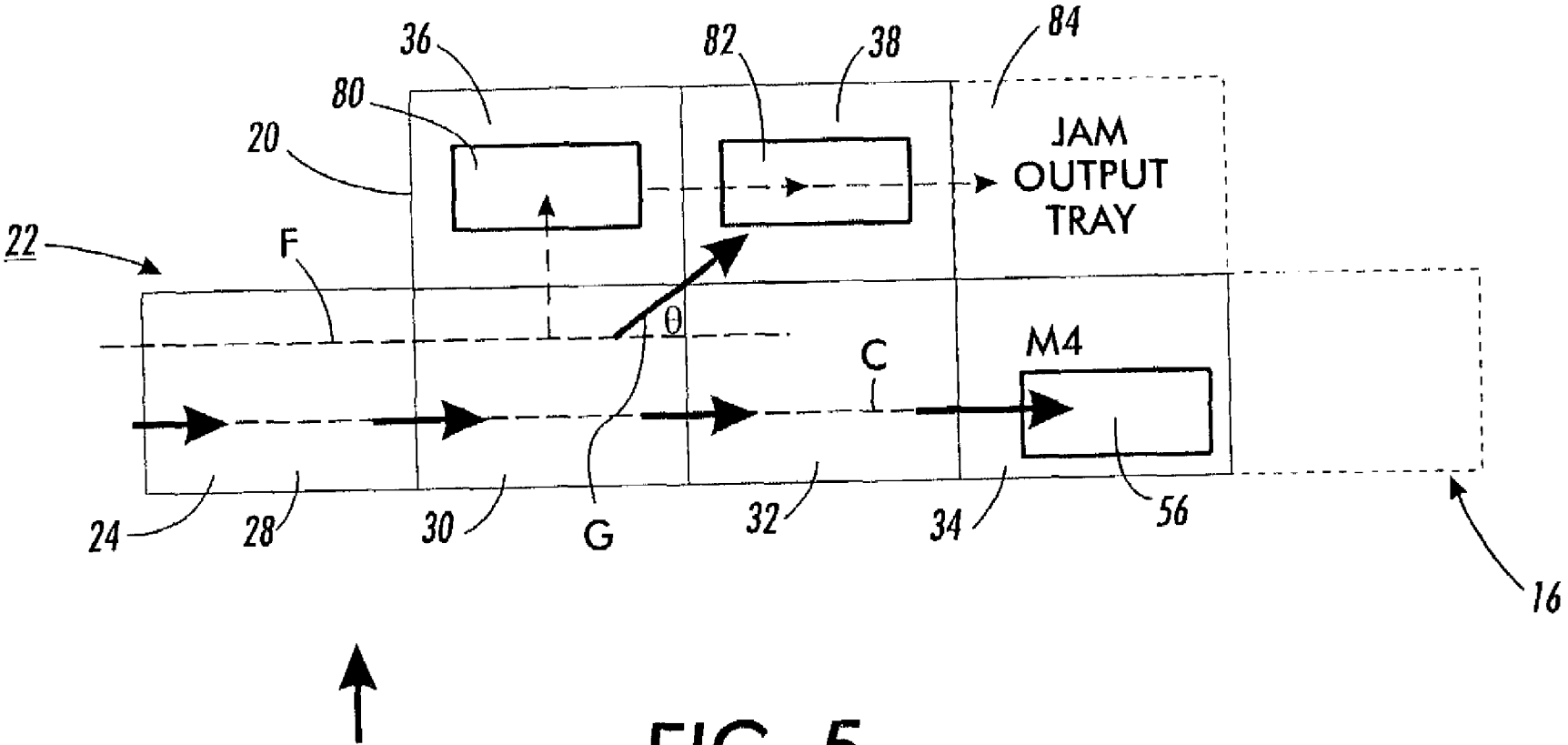
FIG. 5 is a block diagram of a top view of the paper path of FIG. 2, illustrating the diversion of sheets.

In another embodiment, illustrated in FIG. 5, the lookaside path 20 is used as a non-return path. This serves a diversion function. One or more sheets 80, 82, which are determined to be damaged or are otherwise not to form a part of the complete job, are transported along a path marked by arrows F to the lookaside path 20, in a similar manner to that illustrated in FIG. 3. However, instead of returning at a later time to the main path 24, these rejected sheets are diverted to a second output destination 84, such as a jam output tray, which is connected with the lookaside path 20. The remainder of the stream continues along the main path as indicated by arrow C. If there is a paper jam and the system needs to be flushed, only the rejected sheets are diverted and the remainder of the print job can continue, uninterrupted along the main path 24.

It is to be understood that a variety of other translational movements can be achieved with the lookaside path 20. For example, the lookaside path can be used to transport sheets in a reverse direction to that of the main path 24, as illustrated, for example, by the two directional arrows in FIG. 2. In one embodiment, sheets enter the lookaside path via module 32 and are transported to module 38 and from module 38 to module 36. The sheet or sheets can reenter the main path 24 at module 30, in a suitably generated space or spaces, or leave the lookaside pathway via an external device 70, such as a printer, output tray, or the like.

In addition to translational motion in a direction parallel with the main path 24 (e.g., between module 30 and 32 or between modules 36 and 38) and translational motion in a direction perpendicular to the main path (e.g., between modules 30 and 36 or between modules 32 and 38), in one embodiment, one or more of the modules allows translation at an angle θ to the main path direction, optionally after rotation of the sheet, as shown by arrow G in FIG. 5. In this way, sheets can move diagonally, for example, between modules 30 and 38.

It will be appreciated that the flexible media handling apparatus comprising modules 28, 30, 32, 34, 36, 38, can be selectively connected with all or selected ones of the external devices described (e.g., printer 12, output 16, inserter 70, and jam output tray 84). Alternatively, or additionally different external devices may be connected in the positions occupied by these devices. For example, a second printer or finisher may occupy the inserter position or jam output tray position.

Optionally, a reversion module (not shown), such as that described in U.S. Pat. No. 6,554,276 or 6,607,320, is incorporated into the system. The reversion module may be connected with the main path 24 or with the lookaside path 20. The reversion module is generally adapted to revert a substrate, without changing the leading edge orientation of the paper, as is the case in an inversion process.

Figure 6:
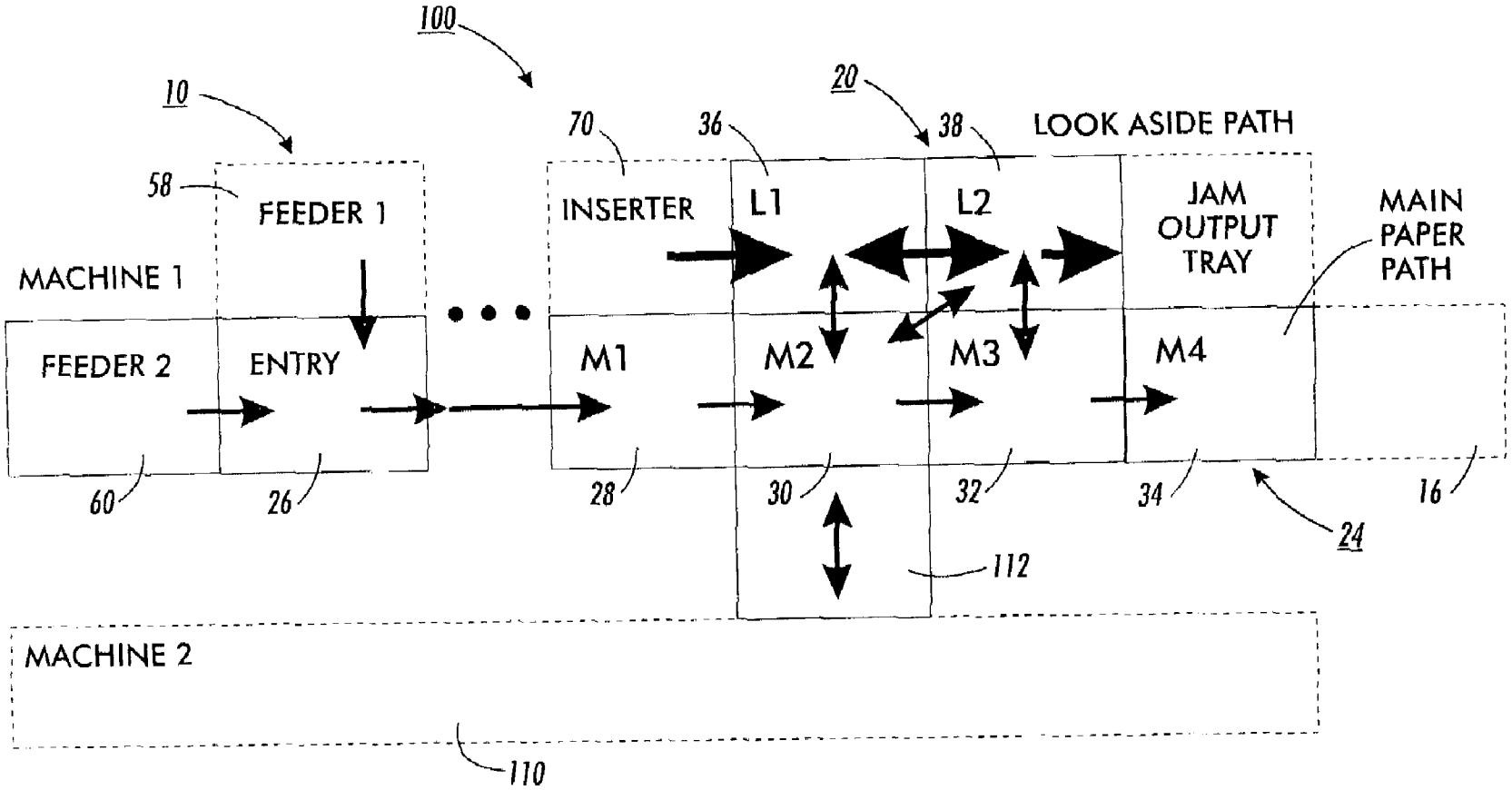
FIG. 6 is a block diagram of a top view of a second embodiment of a paper path for the system of FIG. 1, illustrating the pathways for movement of sheets.

With reference now to FIG. 6, another embodiment of a system 100 is shown. The system 100 includes a device 10 as shown in FIG. 2. A second device 110 (illustrated in phantom), may be similarly configured to device 10, or configured without a lookaside path. The main path 24 of device 10 is connected with a main path or lookaside path of device 110 by a connecting path 112, formed of one or more repositionable modules, similar to those used to form the main path of the device 10.

The connecting path 112 allows sheets from the main path 24 of the device 10 to enter the main path of device 110, or vice versa. For example, if the finisher 16 of device 10 is out of order or occupied with a prior job, the finisher of device 110 can be used.

The various machine functions of the external devices and transport modules shown in the embodiments of FIGS. 2-6 can be regulated by the controller 18, or by separate controllers. The controller 18 is generally a programmable microprocessor that controls all of the machine functions herein described. The controller can, for example, provide a comparison count of the copy sheets, the number of documents being diverted or temporarily stored in the lookaside path, the number of copy sheets selected by the operator, time delays, jam corrections, etc. The control of all of the exemplary systems herein described may be accomplished by conventional control switch inputs from the machine consoles selected by the operator. Conventional sheet path sensors or switches may be utilized to keep track of the position of the documents and the copy sheets.

A goal of a paper transport system in a typical electrophotographic system is to take a sheet of paper and move it from one point in the paper path to another while performing one or more operations, such as reversion, inversion, imaging, transfer, fusing, finishing, and the like in between. The lookaside path 20 described provides one or more of insertion, diversion, and reordering functions and may be combined with other known devices for performing reversion, inversion, imaging, transfer, fusing, finishing, and other related operations.

In both the lookaside path 20 and the main path 24, flexible substrates, such, such as for example paper sheets, are preferably transported by means of a sheet transport system.

Examples of such transport systems can include for example, airjet transport modules, spherical nips ("SNIPS") spin-roller drives, omni-directional drive systems or spherical paper moving devices.

An airjet transport system is generally a paper transport system that uses flowing air instead of rollers to apply the motive force to the paper sheets to move the flexible sheet. The system controller 18 system interacts with individual or local module controllers for the various airjets.

Figure 7:
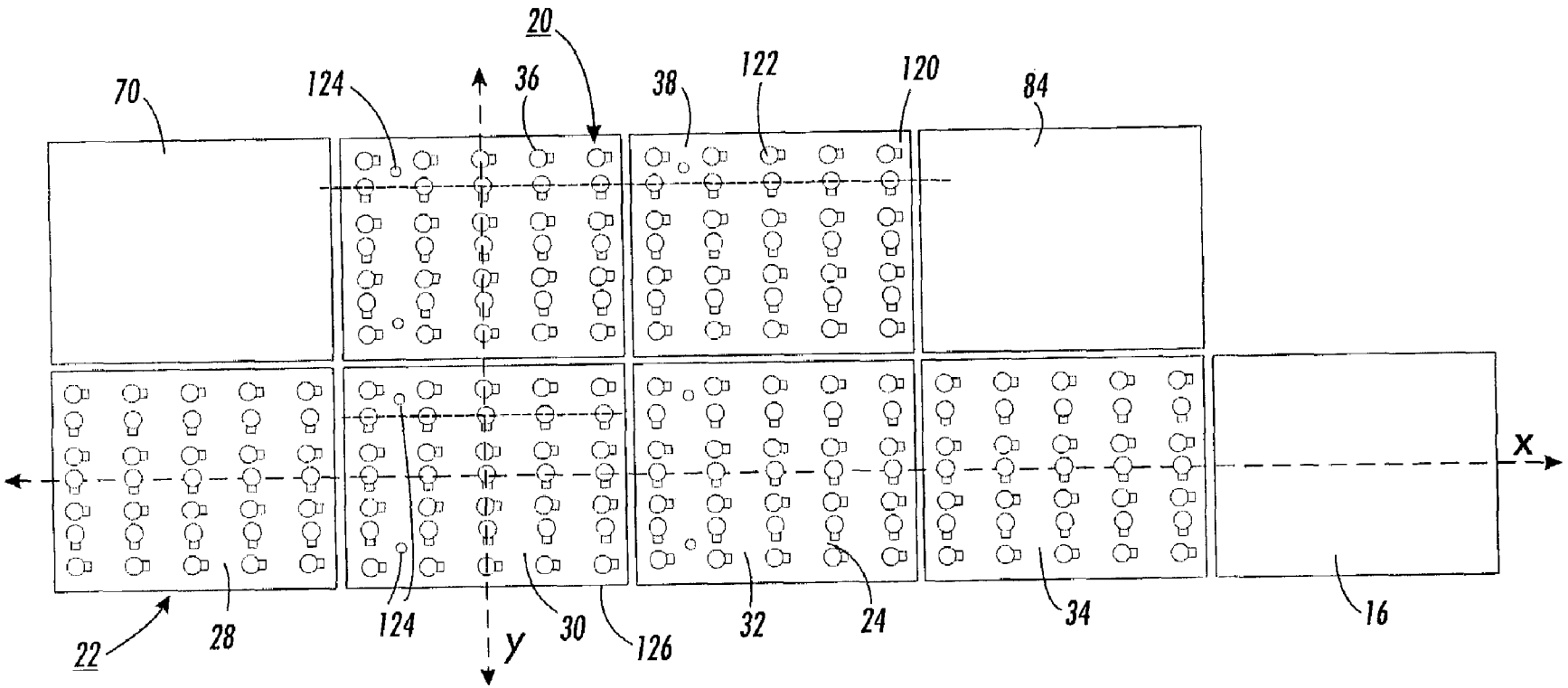
FIG. 7 is a top plan view of the paper path of FIG. 2, illustrating sheet driving elements.

An exemplary airjet transport system, illustrated in FIG. 7, includes a plane 120 of multiple independently operable, spaced sheet driving elements 122 (providing variable angle sheet driving directions) and sensors 124 in an intelligent, adaptive, scaleable, paper path plane, which can simultaneously enter, exit, move and re-position multiple sheets thereon. Any sheet entering at any position can be moved to any other location in the paper path plane. The airjets provide a variable velocity as well as a variable angle sheet movement system.

The driving elements 122 are independently operable for applying a force for moving a sheet in at least two directions, parallel with the X and Y axes, respectively. While in one embodiment, all the driving elements 122 are capable of moving a sheet in any direction within a plane, it is also contemplated that the driving elements 122 are split into groups of driving elements, a first group being operable for moving the sheet in a first direction, and a second group being operable for moving the sheet in a second direction within the same plane, and so forth, depending on the number of directions the sheet is required to move to and from the given module.

An example of a SNIPS paper moving device for two-axis sheet movement and/or rotation is described in U.S. Pat. No. 6,059,284 to Wolf, et al., the disclosure of which is incorporated by reference in its entirety. As disclosed in U.S. Pat. No. 6,059,284, each SNIPS sheet drive has a spherical frictional drive ball engaging any overlying sheet, which drive ball is rotated in any desired direction and speed by two orthogonal servo-driven rollers drivingly engaging the opposite side of the ball. The exemplary multiple selectively directional (variable drive angle) sheet transports may thus be schematically represented herein, and need not be described in detail herein. Similar transport systems which may be employed are disclosed in U.S. Pat. No. 4,836,119 to Siraco, et al. and U.S. Pat. No. 6,241,242 to Munro, incorporated herein by reference in their entireties. Overlying idler balls, pneumatic pressure or suction, or other known paper feeding normal force systems may be added, if desired, to hold the sheets down against the drive balls in addition to sheet gravity.

The airjet transport, spherical nips, omni-direction drive, or two-way NIPs are all examples of transport mechanisms which are capable of moving a body in any direction in a plane defined by mutually perpendicular X and Y axes as well as rotation, within the plane, through any angle (i.e., three degrees of freedom). Such systems are sometimes referred to as holonomic systems. These embodiments can move the part in any direction, including velocity direction, at any time, not just the axes perpendicular to the roller axis as in traditional transport systems.

Examples of a two-way roller system that can be used in the main paper path and/or lookaside path are disclosed in U.S. Pat. Nos. 6,607,320 and 6,554,276, incorporated herein by reference. The two-way rollers permit motion in directions at non-perpendicular angles to the roller axle. In one embodiment, a number of two-way rollers are grouped into perpendicular arrays so that a force in any arbitrary direction within the plane can be exerted on the object by appropriate torque applied to the rollers in the two orthogonal directions. The object is free to move in that direction in response to the force because of the two-way roller action. Arrays of such rollers form holonomic actuators that can be used with the present paper path in that they can provide motion in any direction at any time.

As illustrated in FIG. 7, each of the transport modules 28, 30, 32, 34, 36, 38 comprises a removable and repositionable tile 126, which can be selectively linked by means of suitable linkage mechanisms (not shown) to another tile. In this way, interlocked paths of varying lengths and widths can be formed and reconfigured at will. The tiles each include a plurality of the sheet driving elements 122 (e.g., airjets or SNIPS) and at least one sheet position sensor 124. The sheet driving elements of one tile are independently operable from those of another tile. The sheet driving elements may be independently operable within a tile.

It will be appreciated that the main path 24 and lookaside path 20, or even portions thereof, may employ two or more different sheet driving elements, or combinations of types of driving elements.

An example of a control architecture for sheet handling is described in U.S. Pat. No. 5,999,758 to Rai, et al., the disclosure of which is incorporated by reference in its entirety.

In the embodiment using an airjet system as the fluid transport system, the airjets can be created by a ventilator (not shown) or by an air injector (not shown) and the sheets handled in the manner as described in U.S. Pat. No. 5,634,636 to Jackson, et al., incorporated herein by reference. Referring to FIG. 7, the airjets can generally be formed or directed in various orientations, such as a lateral orientation for pushing the substrate sideways or a forward orientation for pushing the substrate in the process directions. The sensors used generally permit ready detection and correction of trajectory, rotation, slight misalignments, three dimensional misalignments due to flutter, creases, edge turning, or other orientation problems that can be difficult to detect quickly and provide suitable movement compensation using standard material processing movement control systems.

The air jets can be constructed and positioned with respect to a flexible object to enable application of on the order of one millinewton of force to each side of the flexible object, with precise force values depending on material and dynamic properties of the flexible object, along with the desired object acceleration and trajectory. For best operation, the exerted air jet forces are quickly changeable. For example, a typical 0.025 centimeter (0.0635 inches) diameter orifice having a length of about 0.1 centimeter (0.254 inches) would be expected to have an intrinsic response time for air movement on the order of 100 microseconds. Ideally, response times, controllers, motion analysis, and pressure conditions are such that air jet operation and control occurs on about a millisecond time scale, or less.

Various large area multiple optical sensor arrays, such as with LED's and multiple pixel photocells, with SELFOC or other collimating lenses, may be used, and are also known in the art, and in the imaging bar art, and need not be described in detail herein. Particularly noted and incorporated by reference herein is U.S. Pat. No. 6,476,376 to Biegelsen, et al. FIGS. 9 and 11 thereof are noted in particular. Various large area two-dimensional optical object orientation and/or recognition sensors, such as overhead video cameras and associated software, are also known.

The flexible media may be constrained to move within the plane by baffles (not shown) located above and below the plane. The baffles substantially limit the ability for the media to move in a direction out of the plane. Thus, the media is essentially limited to movement only within the XY plane. In one embodiment, the sensors 124 are mounted within the baffles, or are mounted to interior surfaces of the baffles, such that even if the baffles are opaque or occluded, the sensors are capable of sensing the position of the media.

Referring to FIG. 7, control of the flexible object path 22 can be enabled by provision of a plurality of the integrated sensors 124 positioned at desired points along the paths 20, 24, which are embedded in the plane or positioned above or below it. These sensors 124 can include, but are not limited to, optical, mechanical, thermal, electrostatic, or acoustic sensors. The sensors 124 are used to provide continuous or near continuous sensor feedback relating to object position, which in turn allows nearly continuous movement control of sheets passing adjacent to the air jets or other transport mechanism. As will be appreciated, information received from the sensors 124 can be passed to a centralized motion analysis unit and motion control unit (not shown). Alternatively, distributed or local motion analysis and control can be employed. For example, the sensors 124 can be integrated with computer microcircuitry capable of analyzing sensor input and directing control of the transport system.

The transport system described herein allows for manipulation and control of a wide variety of flexible objects and processes. In addition to paper handling, other flexible sheet or articles of manufacture, including extruded plastics, metallic foils, fabrics, mail, banknotes, or even optical fibers can be moved in accurate three-dimensional alignment. As will be appreciated, modification in the layout of the lookaside path 20, which may also be described as a sheet conveyor, are contemplated.

In a copying or printing system, the lookaside path allows for insertion, diversion, and reordering functions at the processing speed even with closely spaced sheets of paper. In order to use a paper path efficiently, for example, the sheets should be as close together as possible. With most current merging or diversion methods, mechanical parts, such as switches, must be moved into position before the rerouting can occur. This takes substantially longer than the rerouting possible in the present system. One of the features of an embodiment of the present lookaside path is that the paper can be rerouted without decelerating the paper sheets traveling in the main path 24. The deceleration process causes the greatest stress on the paper path components, so its elimination greatly improves reliability.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A modular flexible media handling apparatus comprising:

an input module through which flexible media enters the apparatus;

at least one main path module through which flexible media passes along a main path;

at least one lookaside module located off the main path through which flexible media selectively passes along a lookaside path adjacent to and in the same plane as the main path, whereby a first sheet of the flexible media is able to be transported or stored in the lookaside path contemporaneously with a second sheet of the flexible media being transported in an adjacent portion of the main path, the lookaside path communicating with the main path whereby flexible media is transferred from the main path to the lookaside path; and an output module in which flexible media from the lookaside path and main path are merged.

2. The apparatus of claim 1, wherein the at least one lookaside module can selectively move media along at least first and second axes.

3. A modular flexible media handling apparatus comprising:

an input module through which flexible media enters the apparatus;

a plurality of main path modules through which flexible media passes in a plane along a main path;

a plurality of lookaside modules located off the main path through which flexible media selectively passes along a lookaside path in the same plane as the main path, the lookaside path communicating with the main path whereby flexible media is transferred between the main path and the lookaside path, all of the main path modules and lookaside modules being capable of selectively moving media along two axes, the axes of each lookaside module and each of the plurality of main path modules being coplanar with the axes of others of the plurality of lookaside modules and plurality of main path modules; and a controller which controls a length of time flexible media is stored in the lookaside path whereby flexible media transferred from the main path to the lookaside path and stored in the lookaside path is transported back to the main path.

4. A printing system comprising:

an input module through which media enters the system;

a marking device which receives media from the input module;

a plurality of main path modules through which media passes along a main path downstream of the marking device;

at least one lookaside module located off the main path and downstream of the marking device through which media selectively passes along a lookaside path, in the same plane as the main path the lookaside path communicating with the main path whereby media is transferred from the main path to the lookaside path and from the lookaside path to the main path, wherein at least one of the main path modules is capable of moving the media in three angularly spaced directions within a plane.

5. A system comprising:

a marking device;

an input module which receives media from the marking device;

at least one main path module through which media passes along a main path;

a plurality of lookaside modules located off the main path through which media selectively passes along a lookaside path in the same plane as the main path including an upstream lookaside module and a downstream lookaside module, the upstream lookaside module and the downstream module of the lookaside path communicating with the main path whereby media is transferrable from the main path to the lookaside path at one of the downstream and upstream lookaside modules and is transferrable from the lookaside path to the main path at the other of the downstream and upstream lookaside modules;

each of the at least one main path module and lookaside modules including a plurality of driving elements which are capable of moving a sheet in any direction within a plane; and a finisher which receives media from the main path.

6. The system of claim 5, wherein the marking device comprises a plurality of marking modules.

7. The system of claim 5, further comprising;

a second marking device, the lookaside path receiving media from the second marking device.

8. A modular flexible media handling apparatus comprising:

an input module through which flexible media enters the apparatus;

at least one main path module through which flexible media passes in a plane along a main path;

at least one lookaside module located off the main path through which flexible media selectively passes along a lookaside path in the same plane as the main path, the lookaside path communicating with the main path whereby flexible media is transferred between the main path and the lookaside path, wherein a first of the at least one lookaside module is located beside a first of the at least one main path modules and can selectively move media along at least first and second axes in the plane, whereby flexible media is moved along the first axis between the first lookaside module and the first main path module and flexible media is moved along the second axis between the first lookaside module and one of an adjacent second of the at least one main path module and an adjacent second of the at least one lookaside module.

9. The apparatus of claim 8, wherein the at least one main path module is configured for moving media along at least the first and a third angularly spaced axes.

10. The apparatus of claim 9, wherein the third axis is collinear with the main path.

11. The apparatus of claim 9, wherein the first and third angularly spaced axes are spaced at an angle of from 45-135°.

12. The apparatus of claim 1, wherein the at least one main path module accepts media from the input module.

13. The apparatus of claim 12, wherein the at least one main path module accepts media from the input module along the first axis and sends media to a first of the at least one lookaside modules along the second axis.

14. The apparatus of claim 8, wherein the at least one lookaside module includes a plurality of lookaside modules and wherein a first of the main path modules sends media to a first of the plurality of lookaside modules.

15. The apparatus of claim 8, wherein the at least one main path module comprises a first main path module and a second main path module, wherein the first main path module accepts media from the input module and selectively sends the media to a first of the at least one lookaside modules or to the second main path module.

16. The apparatus of claim 15, wherein media is sent to the first lookaside module along a different axis than media sent to the second main path module.

17. The apparatus of claim 8, wherein a media processing unit is connected to one of the at least one lookaside modules for at least one of:

receiving media from the lookaside module; and delivering media to the lookaside module.

18. The apparatus of claim 17, wherein the media processing unit comprises one of the group consisting of a marking device, a finisher, a jam output tray, and a quality consistency checker.

19. The apparatus of claim 8, wherein the at least one main path module comprises a plurality of main path modules and the at least one lookaside module comprises a plurality of lookaside modules, and wherein each of the modules is capable of selectively moving media along two axes, the two axes of each module being coplanar with the two axes of an adjacent module.

20. The apparatus of claim 8, comprising at least two main path modules and at least two lookaside modules.

21. The apparatus of claim 8, wherein the at least one lookaside module comprises a plurality of lookaside modules and the at least one main path module comprises a plurality of main path modules, and wherein each of the plurality of main path modules and lookaside modules includes a sheet transporting system, the sheet transporting system providing selectable sheet translation.

22. The apparatus of claim 21, wherein the sheet transport system includes a plurality of independently operable, spaced sheet driving elements which cooperate for moving flexible media along at least first and second angularly spaced axes.

23. The apparatus of claim 8, wherein the at least one lookaside module comprises a plurality of the lookaside modules and the at least one main path module comprises a plurality of main path modules, and wherein each of the plurality of main path modules and lookaside modules is interchangeable and repositionable.

24. The apparatus of claim 8, wherein the main path extends between a first input module and a first output module and further comprising:

at least one of a second input module and a second output module connected with the lookaside path.

25. The apparatus of claim 8 wherein the at least one main path module comprises at least four interchangeable and repositionable modules.

26. The apparatus of claim 8, wherein the at least one main path module conveys media in a first direction along the main path and the at least one lookaside module conveys media in along the lookaside path in a direction parallel to the first direction.

27. The apparatus of claim 8, wherein the at least one lookaside module comprises a plurality of lookaside modules through which media selectively passes along a lookaside path including an upstream lookaside module and a downstream lookaside module, the upstream lookaside module and the downstream module of the lookaside path communicating with the main path whereby media is transferrable from the main path to the lookaside path at one of the downstream and upstream lookaside modules and is transferrable from the lookaside path to the main path at the other of the downstream and upstream lookaside modules.

28. The apparatus of claim 8, wherein the at least one lookaside module permits at least one of diversion of flexible media from the main path, insertion of flexible media into the main path, and reordering of flexible media in the main path.

* * * * *